US012102228B1

(12) United States Patent
Cheng

(10) Patent No.: US 12,102,228 B1
(45) Date of Patent: Oct. 1, 2024

(54) CONNECTION STRUCTURE OF TWO OPPOSITE SLIDE RAILS FOR DRAWER BASKET MOUNTED ON METAL SHELF

(71) Applicant: WIRE MASTER INDUSTRY CO., LTD., Changhua County (TW)

(72) Inventor: Hsi-Ming Cheng, Changhua County (TW)

(73) Assignee: WIRE MASTER INDUSTRY CO., LTD., Changhua County (TW)

( * ) Notice: Subject to any disclaimer, the term of this patent is extended or adjusted under 35 U.S.C. 154(b) by 0 days.

(21) Appl. No.: 18/123,991

(22) Filed: Mar. 21, 2023

(51) Int. Cl.

| | |
|---|---|
| ***A47B 88/40*** | (2017.01) |
| ***A47B 57/42*** | (2006.01) |
| ***A47B 88/407*** | (2017.01) |
| ***A47B 96/06*** | (2006.01) |

(52) U.S. Cl.
CPC ..... *A47B 88/407* (2017.01); *A47B 57/42* (2013.01); *A47B 96/067* (2013.01)

(58) Field of Classification Search
CPC ..... A47B 88/407; A47B 57/42; A47B 88/402; A47B 96/067; A47B 96/07; A47F 5/103
See application file for complete search history.

(56) References Cited

U.S. PATENT DOCUMENTS 2,103,885 A * 12/1937 Whalen ..... F25D 25/021 312/351
2,174,582 A * 10/1939 Hudon ..... A47C 17/86 312/246
2,478,017 A * 8/1949 Shoemaker ..... F25D 17/042 312/246
3,712,696 A * 1/1973 McDonnell ..... A47B 88/90 248/301
4,527,694 A * 7/1985 Bolt ..... B42F 15/0094 211/162
4,597,616 A * 7/1986 Trubiano ..... A61G 12/00 312/246
4,783,971 A * 11/1988 Alba ..... F25D 21/14 312/334.44
5,205,630 A * 4/1993 Welch ..... A47B 47/021 211/187
6,056,378 A * 5/2000 Semon ..... A47B 88/407 312/246
6,578,720 B1 * 6/2003 Wang ..... A47F 5/01 211/186
8,408,666 B2 * 4/2013 Armstrong ..... A47B 88/407 312/408

(Continued)

*Primary Examiner* — Ko H Chan
(74) *Attorney, Agent, or Firm* — Chun-Ming Shih; LANWAY IPR SERVICES

(57) ABSTRACT

A connection structure of two opposite slide rails is applicable for a respective one drawer basket of multiple drawer baskets mounted on bottoms of multiple holding plates of a metal shelf. The connection structure contains multiple fixing sheets, and a respective one fixing sheet is disposed around a respective one holding plate. The metal shelf comprises multiple fixers, and a respective one fixer is engaged on the respective one fixing sheet and is configured to engage with the two opposite slide rails for the respective one drawer basket. The respective one fixer includes a recess which has a first hooking portion and a second hooking portion. The respective one fixer further includes two grooves which has a first engagement rib extending, a second engagement rib, and a boss.

4 Claims, 9 Drawing Sheets

(56) References Cited

U.S. PATENT DOCUMENTS

| | | | | |
|---|---|---|---|---|
| 9,554,651 | B2 * | 1/2017 | Johnson | A47B 88/40 |
| 2014/0061143 | A1 * | 3/2014 | Hu | A47B 88/40<br>211/133.5 |

* cited by examiner

CONNECTION STRUCTURE OF TWO OPPOSITE SLIDE RAILS FOR DRAWER BASKET MOUNTED ON METAL SHELF

TECHNICAL FIELD

The present disclosure relates to a connection structure of two opposite slide rails for a drawer basket mounted on a metal shelf which is configured to hang the drawer basket on a bottom of a holding plate of the metal shelf, and the metal shelf contains multiple fixers, wherein a respective one fixer is engaged on the respective one fixing sheet and is configured to engage with the two opposite slide rails of a respective one drawer basket, such that the respective one drawer basket is hung on the bottom of the respective one holding plate easily and flexibly.

BACKGROUND

A conventional metal shelf contains at least one support posts, multiple recesses defined on the at least one support posts, and multiple plastic fitting elements selectively engaged with the multiple recesses of the at least one support posts by using multiple locking ribs of the multiple plastic fitting elements, wherein a taper of a respective plastic fitting element matches with a taper of multiple fitting sleeves of multiple holding plates of the conventional metal shelf so that the multiple holding plates engaged with the multiple support posts. The multiple holding plates includes multiple metal bars welded in a grid mesh shape or are made of metal mesh, thus holding objects on the multiple holding plates.

However, the objects will drop to a ground from the multiple holding plates easily without any stop rib arranged on the holding plates. Furthermore, the objects can only be placed on the multiple holding plates, thus having limited accommodation space to the conventional metal shelf.

Referring to FIG. 1, a connection structure of a drawer basket for a conventional metal shelf, the conventional metal shelf 1 contains multiple holding plates 2 and multiple fixers 3 locked on bottoms of the multiple holding plates 2, wherein a respective one holding plate 2 has two opposite slide rails 4, 5 and two coupling sheets 6, 7 connected with the two opposite slide rails 4, 5, wherein a respective one coupling sheet 6, 7 has a receiving orifice configured to screw with a screw bolt. such that the two coupling sheets 6, 7 are locked on a bottom of the respective one holding plate 2, a respective one fixer 3 is connected on the bottom of the respective holding plate 2, and a drawer basket 8 is fitted between the two opposite slide rails 4, 5 so that the drawer basket 8 is fixed, pushed, and pulled to accommodate the objects.

However, the multiple holding plates are screwed on the conventional metal shelf by using the screw bolts to cause a troublesome connection. The multiple fixers are only applicable for a sole size of the multiple drawer baskets, thus having using limitation.

The present invention has arisen to mitigate and/or obviate the afore-described disadvantages.

SUMMARY

A primary aspect of the present invention is to provide a connection structure of two opposite slide rails for a drawer basket mounted on a metal shelf by which the respective one drawer basket is hung on a bottom of the respective one holding plate of the metal shelf.

Another aspect of the present invention is to provide a connection structure of two opposite slide rails for a drawer basket mounted on a metal shelf by which the drawer basket is pushed and pulled to move securely by using the coupling column to avoid a removal.

To obtain above-mentioned aspects, a connection structure of two opposite slide rails provided by the present invention is applicable for a respective one drawer basket of multiple drawer baskets mounted on bottoms of multiple holding plates of a metal shelf, and the connection structure contains: multiple fixing sheets, and a respective one fixing sheet is disposed around a peripheral sides of a respective one holding plate. The metal shelf contains multiple fixers, and a respective one fixer is engaged on the respective one fixing sheet and is configured to engage with the two opposite slide rails for the respective one drawer basket.

The respective one fixer includes a recess defined on an inner wall of an upper portion thereof and engaged with the respective one fixing sheet of the respective one holding plate, and the recess of the respective one fixer has a first hooking portion and a second hooking portion which extend from a top and a bottom of the recess and configured to engage with a top and a bottom of the respective one fixing sheet of the respective one holding plate, such that the respective one fixer is fixed on an outer wall of the respective one fixing sheet of the respective one holding plate. The respective one fixer further includes two grooves defined on two sides of a lower portion thereof, and a respective one groove has a first engagement rib extending from a top thereof, a second engagement rib extending from a bottom of the respective one groove, and a boss extending from an inner wall of the respective one groove, such that the respective one groove of the respective one fixer is engaged with a slide rail of the respective one drawer basket, the first engagement rib and the second engagement rib of the respective one groove are engaged with a top and a bottom of the respective one respective one slide rail, and the boss of the respective one groove is engaged with a respective one of multiple notches of the respective one slide rail, such that the respective one slide rail is connected among four fixers which are fixed on the respective one fixing sheet of the respective one holding plate, and the respective one drawer basket is slidably fitted on the two opposite slide rails, thus hanging the respective one drawer basket on the respective one holding plate.

Preferably, the respective one fixer further includes a first receiving orifice and a second receiving orifice which are defined on an inner wall of the lower portion of the respective one fixer. A coupling column is received in two first receiving orifices or two second receiving orifices of any two adjacent fixers, and a length of the coupling column is changeable based on a width of the respective drawer basket.

DETAILED DESCRIPTION

Figure 1:
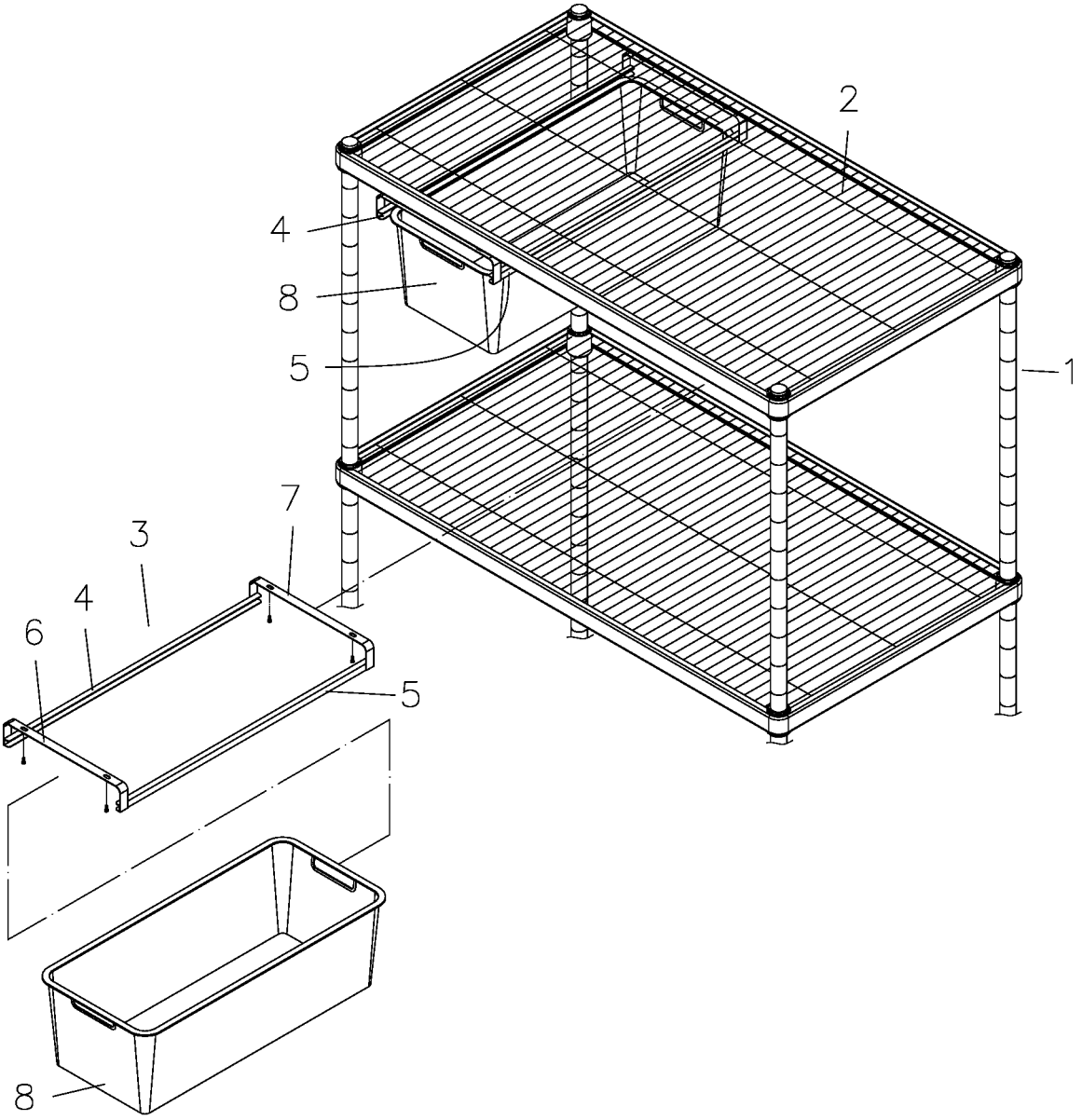
FIG. 1 Prior Art
FIG. 1 is a perspective view showing the exploded components of a connection structure of a drawer basket for a conventional metal shelf.
Figure 2:
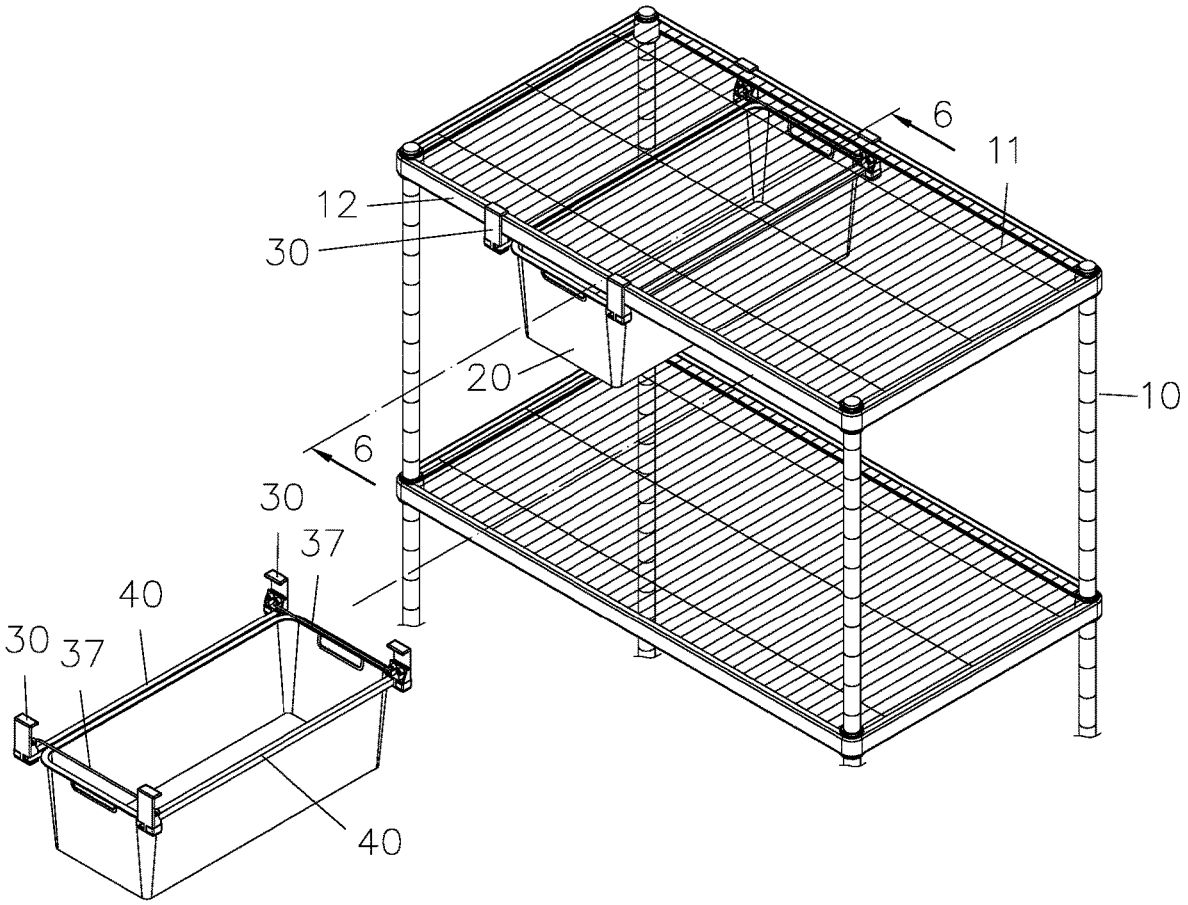
FIG. 2 is a perspective view showing the exploded components of a connection structure of two opposite slide rails for a drawer basket mounted on a metal shelf according to a preferred embodiment of the present invention.
Figure 3:
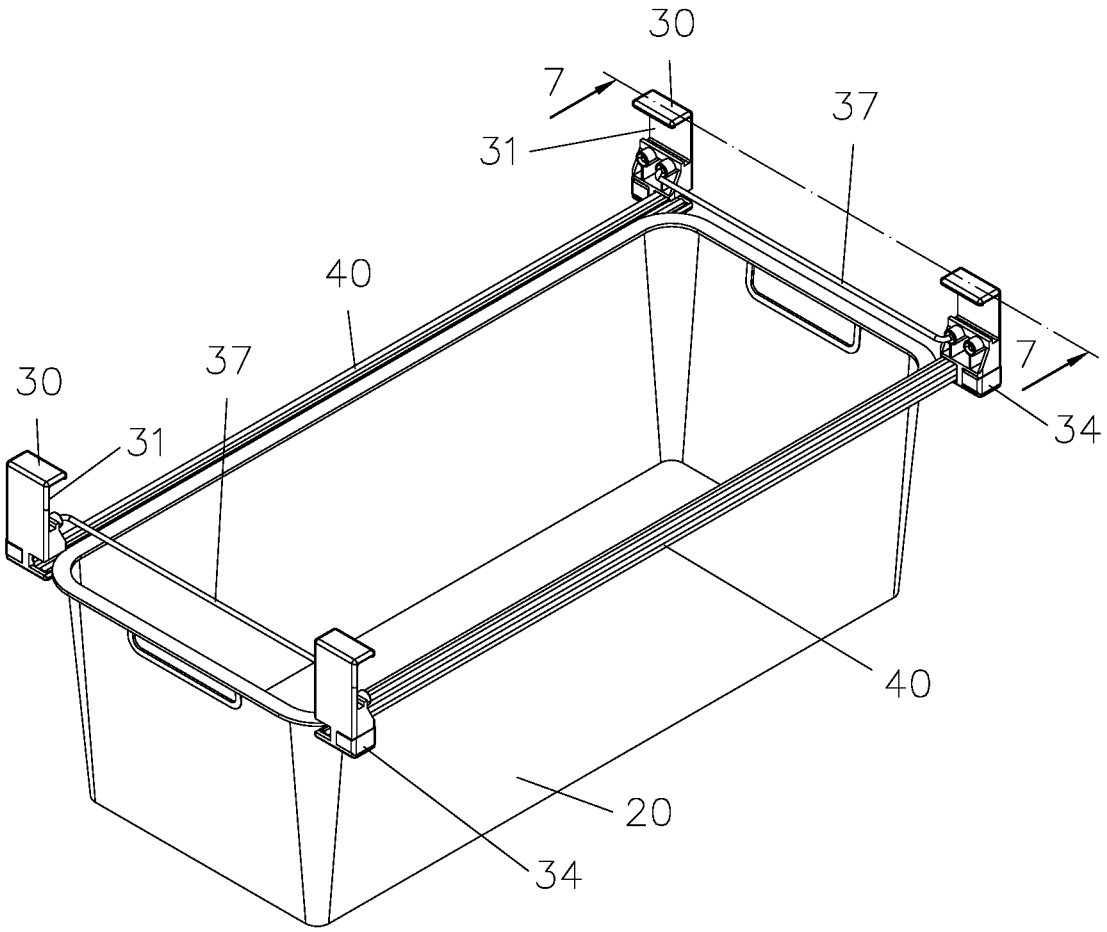
FIG. 3 is a perspective view showing the assembly of the connection structure of the two opposite slide rails for the drawer basket mounted on the metal shelf according to the preferred embodiment of the present invention.
Figure 4:
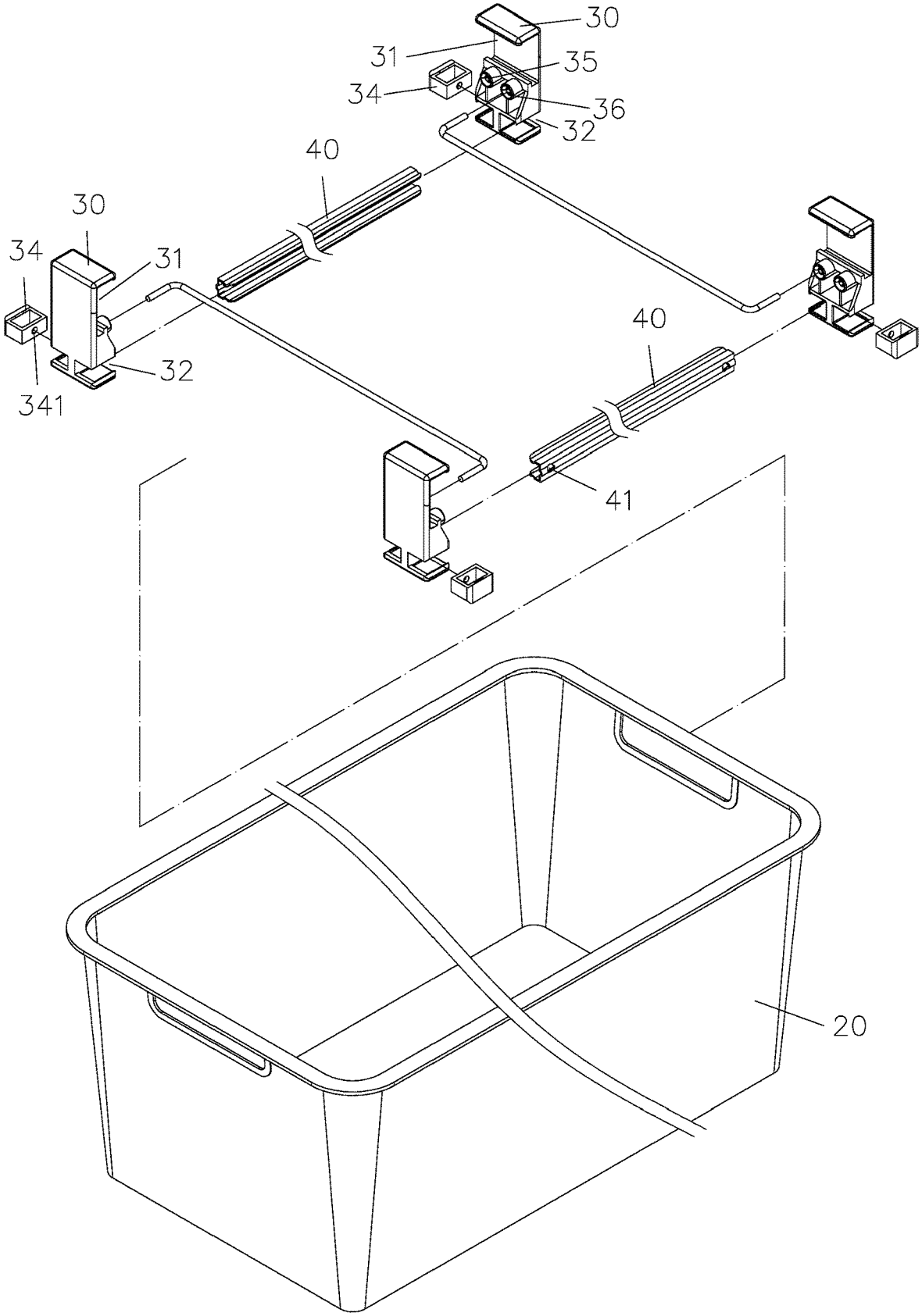
FIG. 4 is a perspective view showing the exploded components of a part of the connection structure of the two opposite slide rails for the drawer basket mounted on the metal shelf according to the preferred embodiment of the present invention.
Figure 5:
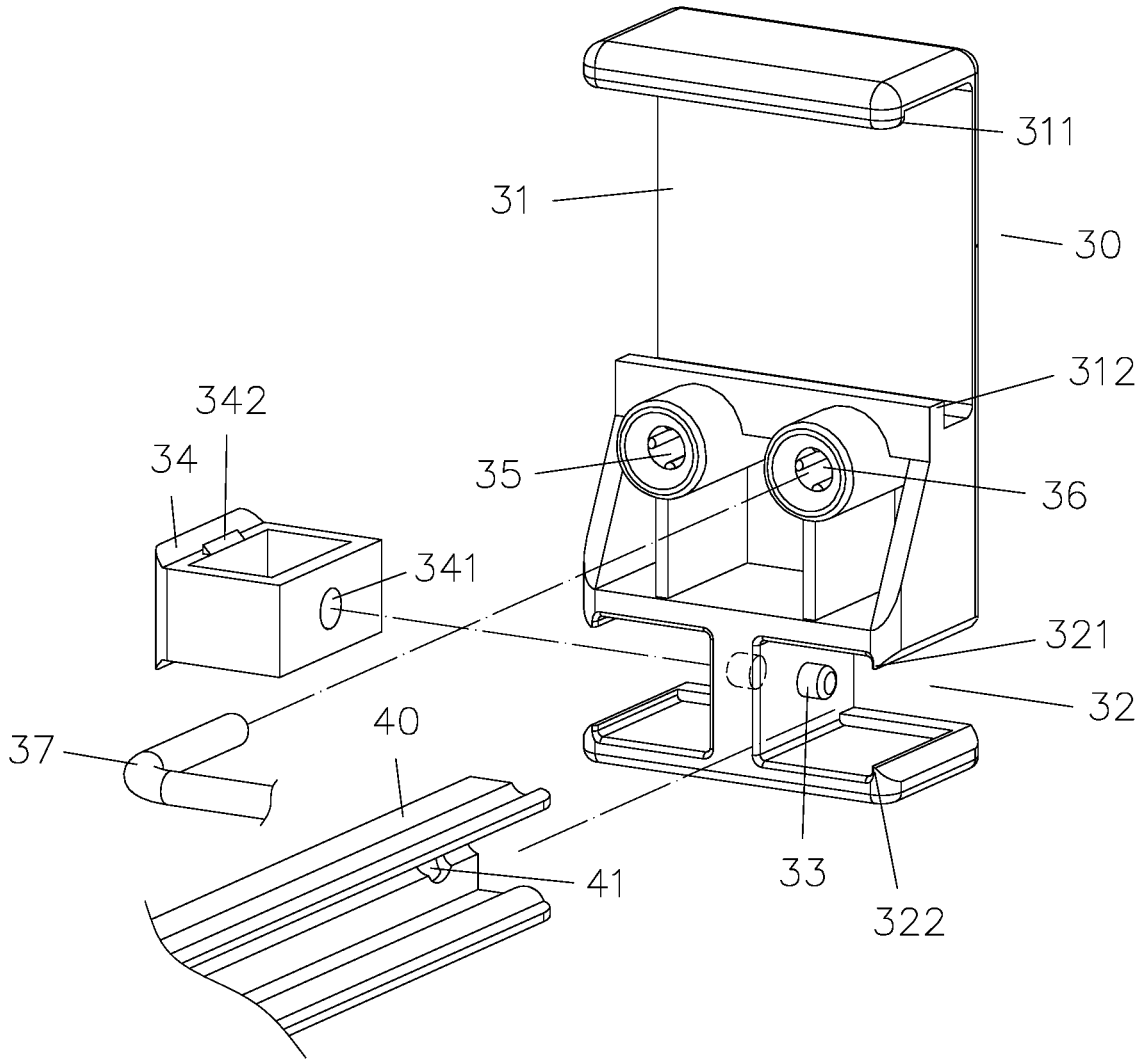
FIG. 5 is another perspective view showing the exploded components of a part of the connection structure of the two opposite slide rails for the drawer basket mounted on the metal shelf according to the preferred embodiment of the present invention.
Figure 6:
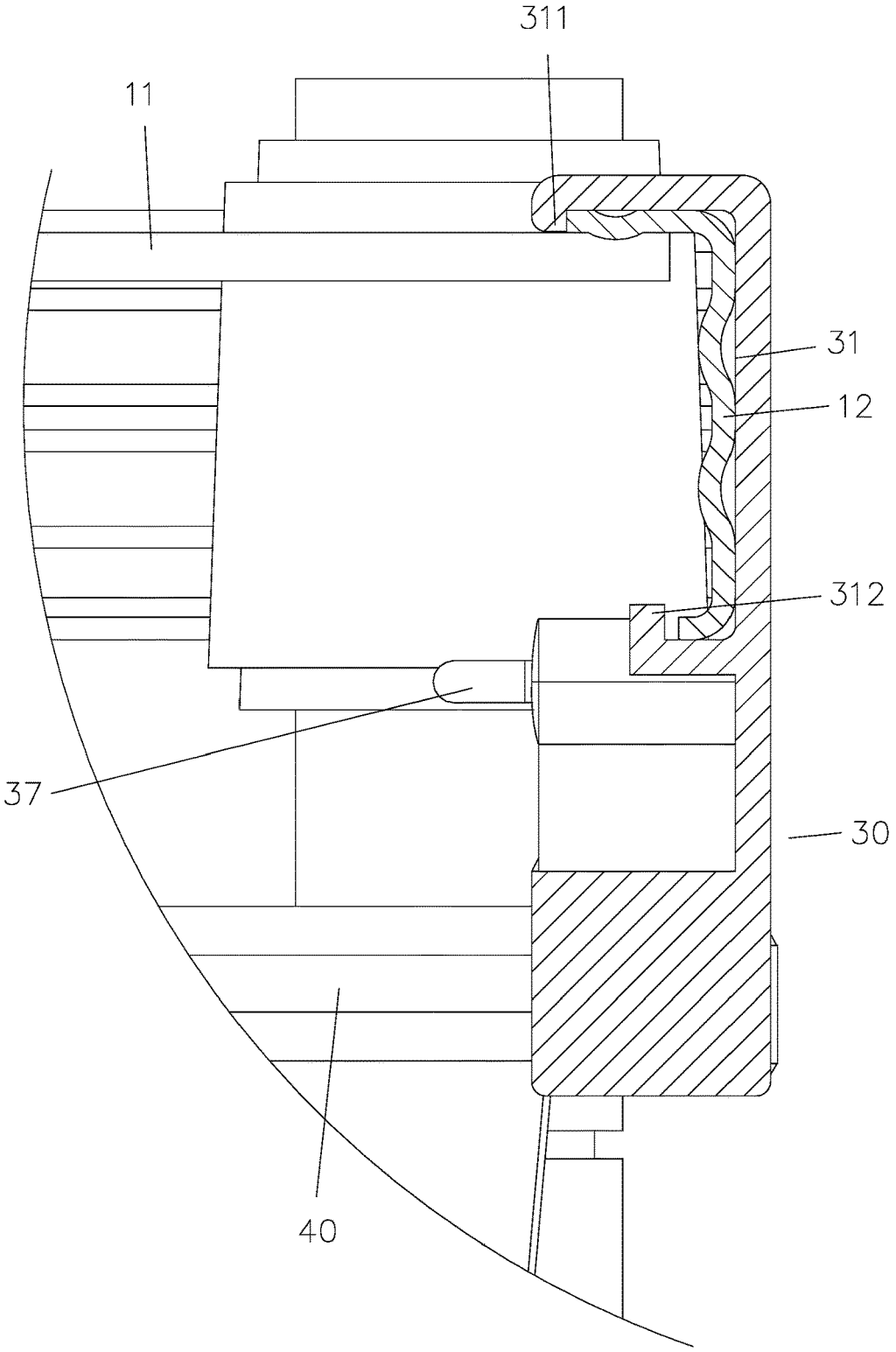
FIG. 6 is a cross sectional view showing the operation of a part of the connection structure of the two opposite slide rails for the drawer basket mounted on the metal shelf according to the preferred embodiment of the present invention.
Figure 7:
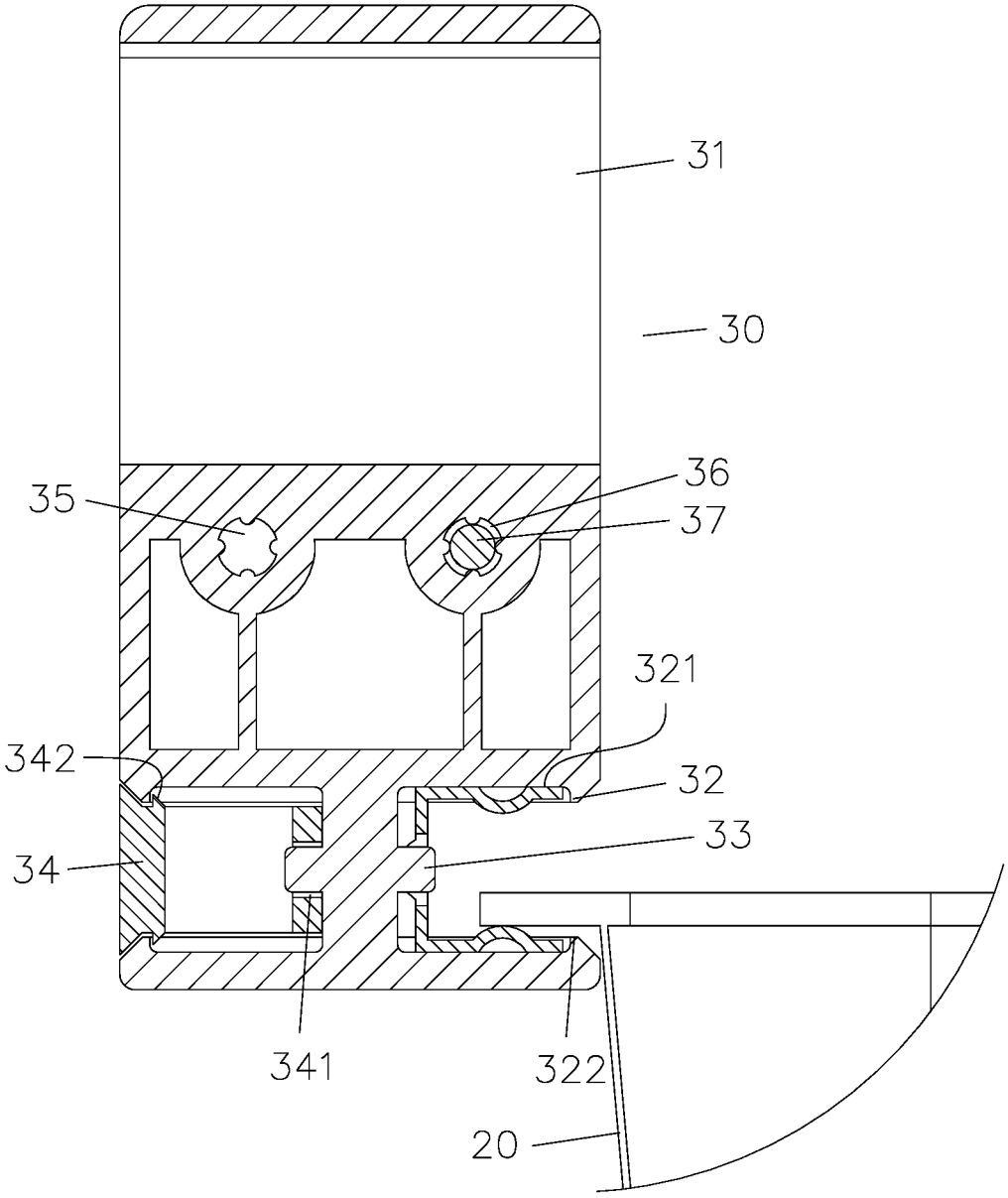
FIG. 7 is a cross sectional view showing the operation of a part of the connection structure of the two opposite slide rails for the drawer basket mounted on the metal shelf according to the preferred embodiment of the present invention.
Figure 8:
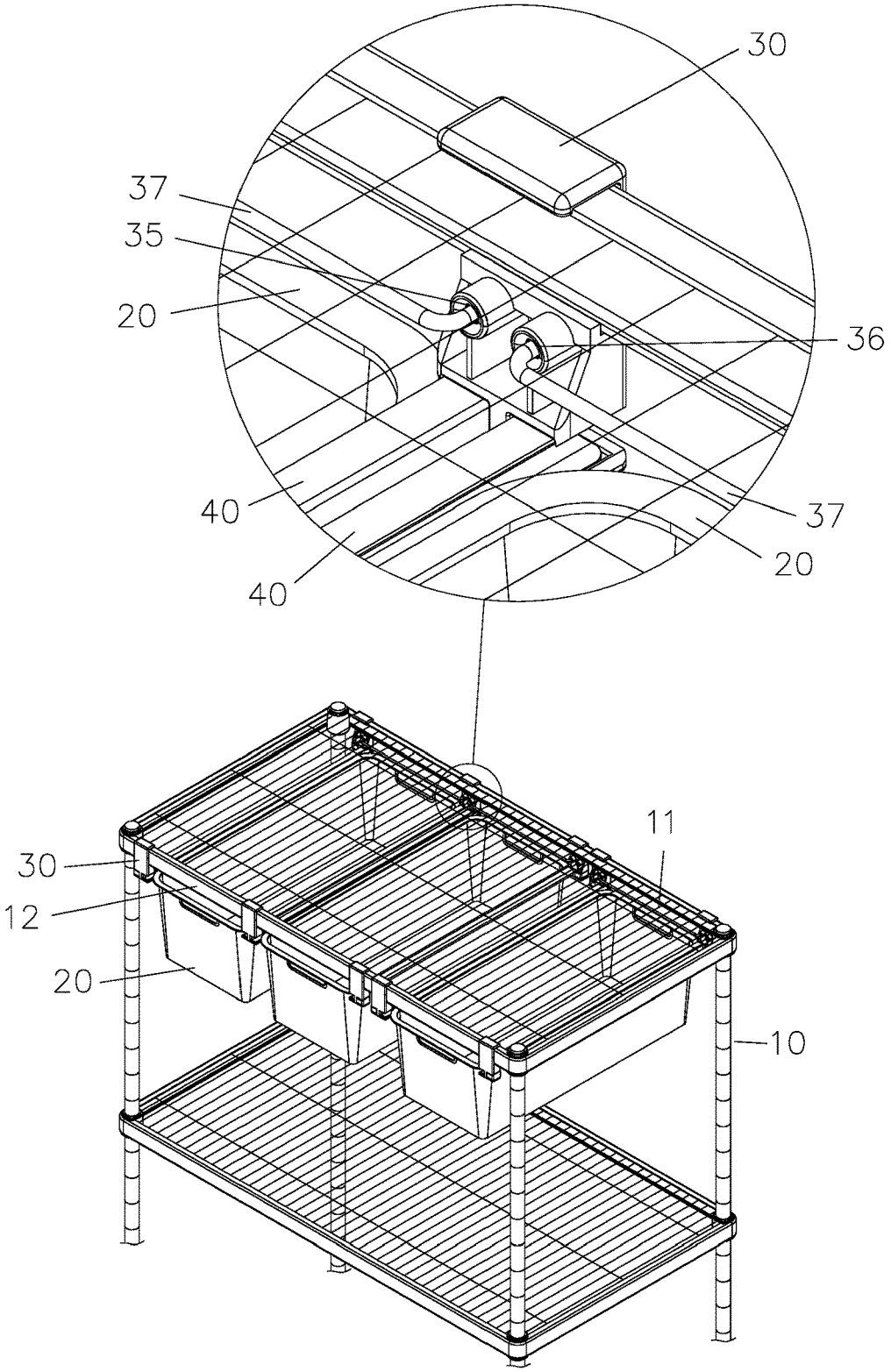
FIG. 8 is a perspective view showing the application of the connection structure of the two opposite slide rails for the drawer basket mounted on the metal shelf according to the preferred embodiment of the present invention.
Figure 9:
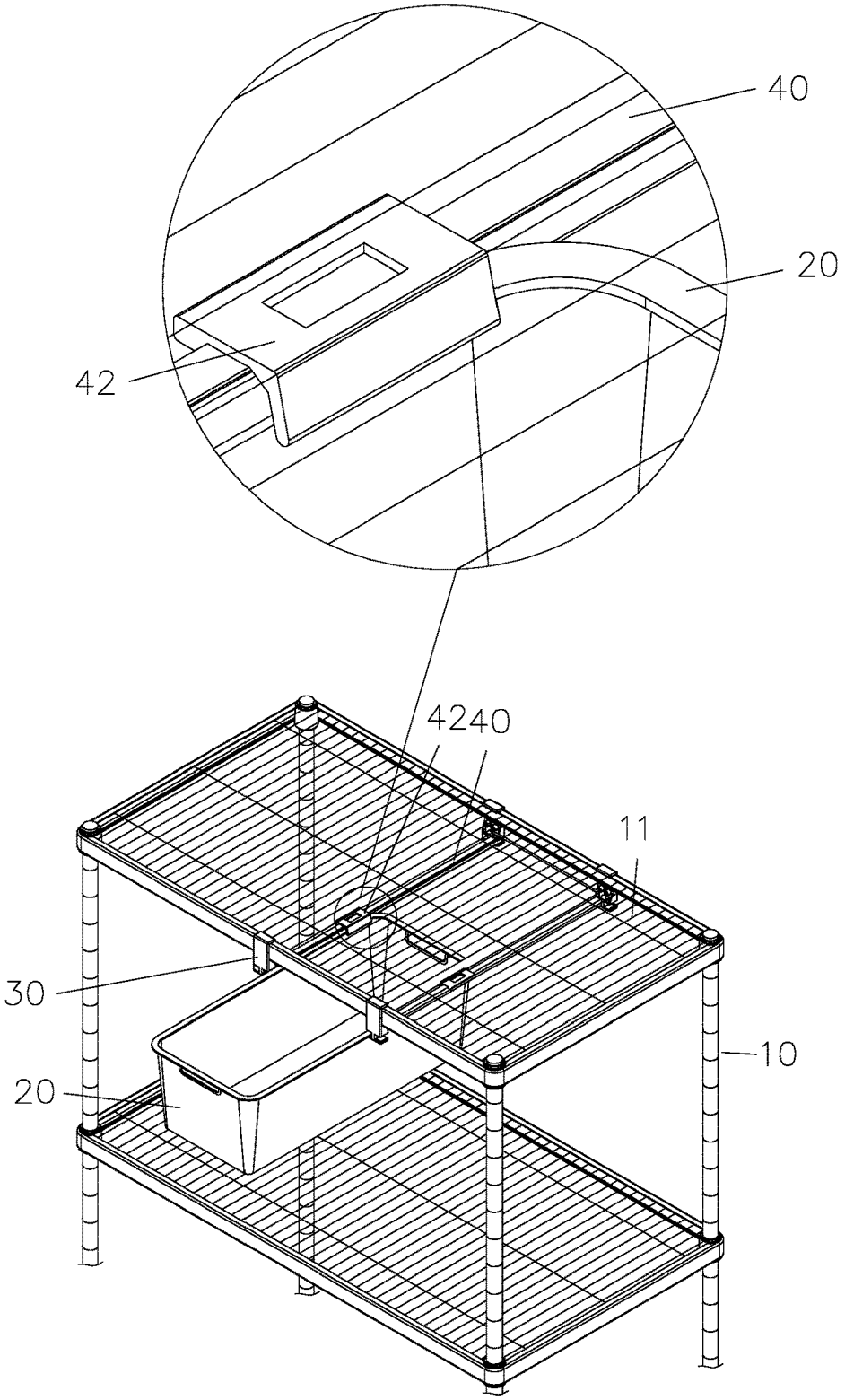
FIG. 9 is another perspective view showing the application of the connection structure of the two opposite slide rails for the drawer basket mounted on the metal shelf according to the preferred embodiment of the present invention

With reference to FIGS. 2-9, a connection structure of two opposite slide rails according to a preferred embodiment of the present invention is applicable for a respective one of multiple drawer baskets 20 mounted on a bottom of a respective one of multiple holding plates 11 of a metal shelf 10, the metal shelf 10 comprises the multiple holding plates 11 and multiple fixing sheets 12, wherein a respective one fixing sheet 12 is disposed around a peripheral sides of the respective one holding plate 11, and the metal shelf 10 comprises multiple fixers 30, wherein a respective one fixer 30 is engaged on the respective one fixing sheet 12 and is configured to engage with the two opposite slide rails 40 of a respective one drawer basket 20, such that the respective one drawer basket 20 is hung on the bottom of the respective one holding plate 11.

The respective one fixer 30 includes a recess 31 defined on an inner wall of an upper portion thereof and engaged with the respective one fixing sheet 12 of the respective one holding plate 11, and the recess 31 of the respective one fixer 30 has a first hooking portion 311 and a second hooking portion 312 which extend from a top and a bottom of the recess 31 and configured to engage with a top and a bottom of the respective one fixing sheet 12 of the respective one holding plate 11, such that the respective one fixer 30 is fixed on an outer wall of the respective one fixing sheet 12 of the respective one holding plate 11. The respective one fixer 30 includes two grooves 32 defined on two sides of a lower portion thereof, and a respective one groove 32 has a first engagement rib 321 extending from a top thereof, a second engagement rib 322 extending from a bottom of the respective one groove 32, and a boss 33 extending from an inner wall of the respective one groove 32, such that the respective one groove 32 of the respective one fixer 30 is engaged with the slide rail 40 of the respective one drawer basket 20, the first engagement rib 321 and the second engagement rib 322 of the respective one groove 32 are engaged with a top and a bottom of a respective one respective one slide rail 40, and the boss 33 of the respective one groove 32 is engaged with a respective one of multiple notches 41 of the respective one slide rail 40. In connection, the respective one slide rail 40 is connected among four fixers 30 which are fixed on the respective one fixing sheet 12 of the respective one holding plate 11, and the respective one drawer basket 20 is slidably fitted on the two opposite slide rails 40, thus hanging the respective one drawer basket 20 on the respective one holding plate 11. Preferably, the respective one slide rail 40 further includes a retainer 42 engaged thereon so that the respective one drawer basket 20 is pushed and pulled along the respective one slide rail 40 and is not removed by using the retainer 42.

The two grooves 32 of the respective one fixer 30 are fitted with any two adjacent drawer baskets 20, wherein one of the two grooves 32 located on an outermost sides of the respective one fixer 30 is covered by a decoration projection 34, and the decoration projection 34 is formed in a frame shape to mate with a profile of the respective one groove 32, wherein the decoration projection 34 has an aperture 341 defined on an inner wall thereof, two engagement tabs 342 extending on a top and a bottom of an outer wall of the decoration projection 34 and engage with the first engagement rib 321 and the second engagement rib 322 of the respective one groove 32, such that the decoration projection 34 covers the respective one groove 32, thus obtaining aesthetics appearance. The respective one fixer 30 further includes a first receiving orifice 35 and a second receiving orifice 36 which are defined on an inner wall of the lower portion of the respective one fixer 30, wherein a coupling column 37 is received in two first receiving orifices 35 or two second receiving orifices 36 of any two adjacent fixers 30, and a length of the coupling column 37 is changeable based on a width of the respective drawer basket 20, hence the drawer basket 20 is pushed and pulled to move securely by using the coupling column 37 to avoid a removal.

Accordingly, the respective one slide rail of the respective one drawer basket is manufactured easily, and a distance between any two adjacent fixers is adjustable to adjust a distance of the respective one based on a size of the respective one drawer basket, thus hanging drawer baskets of different sizes, thus obtaining using flexibility.

The connection structure of the two opposite slide rails for the drawer basket mounted on metal shelf contains the multiple fixers engaged on the peripheral side of the respective one holding plate of the metal plate, and the two opposite slide rails are configured to fit the respective one basket drawer to hang the drawer basket on the bottom of the respective one holding plate, thus obtaining using flexibility.

the respective one slide rail of the respective one drawer basket is manufactured easily, and a distance between any two adjacent fixers is adjustable to adjust a distance of the respective one based on a size of the respective one drawer basket, thus hanging drawer baskets of different sizes, thus obtaining using flexibility.

Having described the invention in detail, it will be apparent that modifications and variations are possible without departing from the scope of the invention defined in the appended claims.

When introducing elements of the present invention or the preferred embodiments thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A connection structure for a drawer basket mounted on a holding plate of a metal shelf, the connection structure comprising:

two slide rails mounted on opposite sides of the drawer bracket, respectively;

a plurality of fixers mounted on the two slide rails; and fixing sheet disposed around a peripheral of the holding plate, wherein the plurality of fixers are engaged on the fixing sheet;

wherein each fixer includes a recess defined on an inner wall of an upper portion thereof and engaged with the fixing sheet, and a first hooking portion and a second hooking portion which extend from a top and a bottom of the recess are configured to engage with a top and a bottom of the fixing sheet, respectively, such that the plurality of fixers are engaged on an outer wall of the fixing sheet, wherein each fixer further includes two grooves respectively defined on two sides of a lower portion thereof, and a respective one groove has a first engagement rib extending from a top thereof, a second engagement rib extending from a bottom thereof, and a boss extending from an inner wall thereof, such that the respective one groove is engaged with a respective one slide rail, the first engagement rib and the second engagement rib are respectively engaged with a top and a bottom of the respective one slide rail, and the boss is engaged with a notch of the respective one slide rail, such that the respective one slide rail is mounted with one fixer, and the drawer basket is slidably fitted on the two slide rails, thus hanging the drawer basket on the holding plate.

2. The connection structure as claimed in claim 1, wherein the two grooves of the one fixer are respectively fitted with any two adjacent slide rails for two drawer baskets, wherein one of the two grooves located on an outermost side of the respective one fixer is covered by a decoration projection, and the decoration projection is formed in a frame shape to mate with a profile of the respective one groove, wherein the decoration projection has an aperture defined on an inner wall thereof, two engagement tabs extending on a top and a bottom of an outer wall of the decoration projection and engage with the first engagement rib and the second engagement rib of the respective one groove, respectively, such that the decoration projection covers the respective one groove, thus obtaining aesthetics appearance.

3. The connection structure as claimed in claim 1, wherein the one fixer further includes a first receiving orifice and a second receiving orifice which are defined on an inner wall of the lower portion of the one fixer, wherein a coupling column is received in two first receiving orifices or two second receiving orifices of any two adjacent fixers, and a length of the coupling column is changeable based on a width of the respective drawer basket, hence the drawer basket is pushed and pulled to move securely by using the coupling column.

4. The connection structure as claimed in claim 1, wherein the respective one slide rail further includes a retainer engaged thereon so that the drawer basket is pushed and pulled along the respective one slide rail and is not removed by using the retainer.

* * * * *